US005158384A

United States Patent [19]

Radmilovic et al.

[11] Patent Number: 5,158,384

[45] Date of Patent: Oct. 27, 1992

[54] CARICATURE PEN WITH INTEGRAL MEMORANDUM PAPER DISPENSER

[75] Inventors: George Radmilovic, Parma; Peter F. Bertolo, Chesterland; Mario G. Bertolo, South Euclid, all of Ohio

[73] Assignee: Mr. Memo Products, Inc., South Euclid, Ohio

[21] Appl. No.: 637,073

[22] Filed: Jan. 3, 1991

[51] Int. Cl.[5] ..... B43K 29/12

[52] U.S. Cl. ..... 401/195; 24/11 F; 401/52

[58] Field of Search ..... 401/88, 195, 52, 209, 401/195, 52; 24/11 F

[56] References Cited

U.S. PATENT DOCUMENTS

| | | | |
|---|---|---|---|
| 485,261 | 1/1892 | Crowe et al. . | |
| 555,752 | 3/1896 | Bacho . | |
| 640,543 | 1/1900 | Donning . | |
| 1,212,020 | 1/1917 | Contant, Jr. . | |
| 1,266,299 | 5/1918 | Moore | 401/52 |
| 1,359,725 | 11/1920 | Moore . | |
| 1,374,882 | 4/1921 | Curtis | 401/195 X |
| 1,377,578 | 5/1921 | Harris | 401/195 X |
| 1,476,582 | 12/1923 | Beadles . | |
| 1,545,399 | 7/1925 | Clennan . | |
| 1,546,715 | 7/1925 | Calvento . | |
| 2,073,719 | 3/1937 | Ross . | |
| 2,076,035 | 4/1937 | Lar Rieu, Jr. . | |
| 2,224,470 | 12/1940 | Boust . | |
| 2,287,618 | 6/1942 | Josephs . | |
| 2,301,364 | 11/1942 | Bruck et al. . | |
| 3,128,514 | 4/1964 | Parker et al. | 401/52 X |
| 3,963,358 | 6/1976 | Houser . | |
| 4,030,842 | 6/1977 | White et al. . | |
| 4,468,146 | 8/1984 | Tabachnik | 401/88 |
| 4,728,212 | 3/1988 | Spector | 401/209 X |
| 4,812,069 | 3/1989 | White et al. . | |
| 4,872,775 | 10/1989 | Chang | 401/195 X |
| 4,963,048 | 10/1990 | Thomas et al. | 401/195 |
| 4,979,840 | 12/1990 | Madaus et al. | 401/202 |
| 4,989,801 | 2/1991 | Thomas et al. | 401/195 X |

FOREIGN PATENT DOCUMENTS

| | | | |
|---|---|---|---|
| 831372 | 2/1952 | Fed. Rep. of Germany | 24/11 F |
| 66881 | 10/1957 | France | 401/195 |
| 360050 | 11/1931 | United Kingdom | 401/195 |
| 2106044 | 4/1983 | United Kingdom | 401/195 |

*Primary Examiner*—Steven A. Bratlie

*Attorney, Agent, or Firm*—Fay, Sharpe, Beall, Fagan, Minnich & McKee

[57] ABSTRACT

A rear pen portion (12) has a notch (18) defined longitudinally therein from a dividing wall (22) to an upper end. A front pen portion (10) has a caricature of a face (14) molded therein and is permanently secured to the rear pen portion. The notch defines a paper access slot longitudinally above the dividing wall. A roll (32) of perforated paper is received in a paper cavity (26) above the dividing wall. A top (36) closes the paper cavity. A cap (40) protects a nib (30) or other writing point from damage and drying out. A pocket clip (50) which is slidably received on the cap has at least a pair of hands (58) which reach over and grasp a user's pocket or other mounting surface.

18 Claims, 4 Drawing Sheets

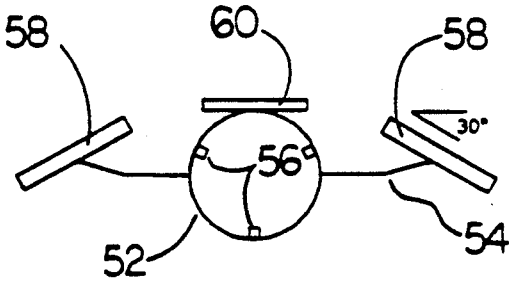
FIG. 3
FIG.4A
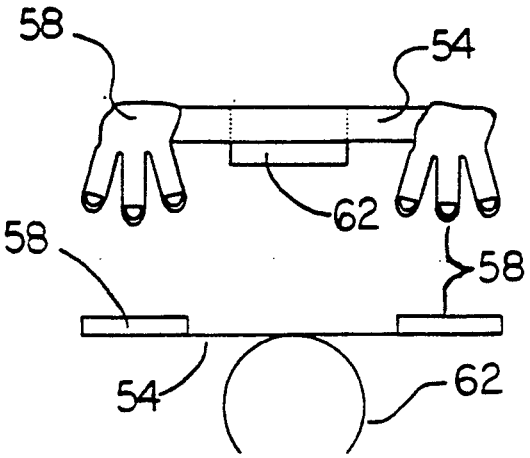
FIG. 4B
FIG. 5
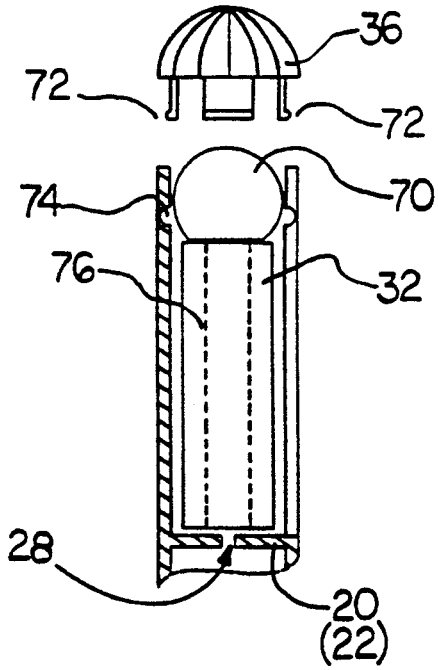

CARICATURE PEN WITH INTEGRAL MEMORANDUM PAPER DISPENSER

BACKGROUND OF THE INVENTION

The present invention relates to writing instruments and memorandum paper dispensers. It finds particular application in conjunction with a combined caricature memorandum pen and roll paper dispenser and will be described with particular reference thereto. However, it is to be appreciated, that the invention will also find application in conjunction with felt tip markers, mechanical pencils, and other writing instruments, writing instruments with different caricatures, caricature writing instruments without paper dispensers, writing instruments with other types of paper dispensers, novelty toys, and the like.

Heretofore, pencils, fountain pens, ballpoint pens, and the like have been designed which incorporate a paper holder in the body thereof. Many of the prior art paper holders included ratchet and other complex mechanical feed mechanisms for controlling the feed of the contained memorandum paper. Such mechanisms were relatively expensive to manufacture, subject to early failure, subject to jamming, and the like.

Some prior art paper dispensers incorporated in writing instruments included paper cutting structures. More complex paper cutting structures which utilized moving parts were again mechanically complex, expensive, subject to jamming, and the like. Paper cutters which incorporated a sharp edge were apt to cut the user and can be particularly dangerous to children.

The prior art writing instruments with built-in paper dispensers tended to be relatively bulky and clumsy. The exterior design was relatively dull and unattractive.

Typically, the paper dispensing portion of the prior art writing mechanisms was mounted in the region that a pocket clip would be found on a writing instrument without a paper dispenser. The paper dispensing mechanism in many instances rendered a pocket clip unavailable or inconvenient.

The present invention contemplates a new and improved memorandum writing instrument which overcomes the above-referenced problems and others.

SUMMARY OF THE INVENTION

In accordance with one aspect of the present invention, a combined writing instrument and memorandum paper dispenser has an integrally molded caricature.

In accordance with another aspect of the present invention, a writing instrument with built-in paper dispenser is provided in which the paper dispenser is free of gears and complex parts.

In accordance with one more limited aspect of the present invention, the paper is perforated to facilitate neat clipping of the paper without sharp and dangerous cutting edges.

In accordance with another more limited aspect of the present invention, a friction pad, such as a foam ball, is mounted in frictional contact with a roll of paper to be dispensed to control paper rotation.

In accordance with another aspect of the present invention, a caricature writing instrument is provided in combination with accessories such as a removable pocket clip, glasses, hats, and other humorous accessories.

In accordance with a more limited aspect, the accessories utilize multi-point attachments or contact surfaces.

One advantage of the present invention resides in its simplicity.

Another advantage of the present invention is its eye-catching appearance.

Another advantage of the present invention is that it is child safe.

Still further advantages of the present invention will be apparent to those of ordinary skill in the art upon reading and understanding the following detailed description of the preferred embodiment.

BRIEF DESCRIPTION OF THE DRAWINGS

The invention may take form in various parts and arrangements of parts, and in various steps and arrangements of steps. The drawings are only for purposes of illustrating a preferred embodiment and are not to be construed as limiting the invention.

FIG. 3 is a top view of the shirt clip of FIG. 1 with the top cap removed;

FIGS. 4A and 4B are top and front views of an alternate embodiment of a pocket clip;

FIG. 5 illustrates a foam brake arrangement for braking rotation of the paper roll;

DETAILED DESCRIPTION OF THE PREFERRED EMBODIMENT

Figure 1:
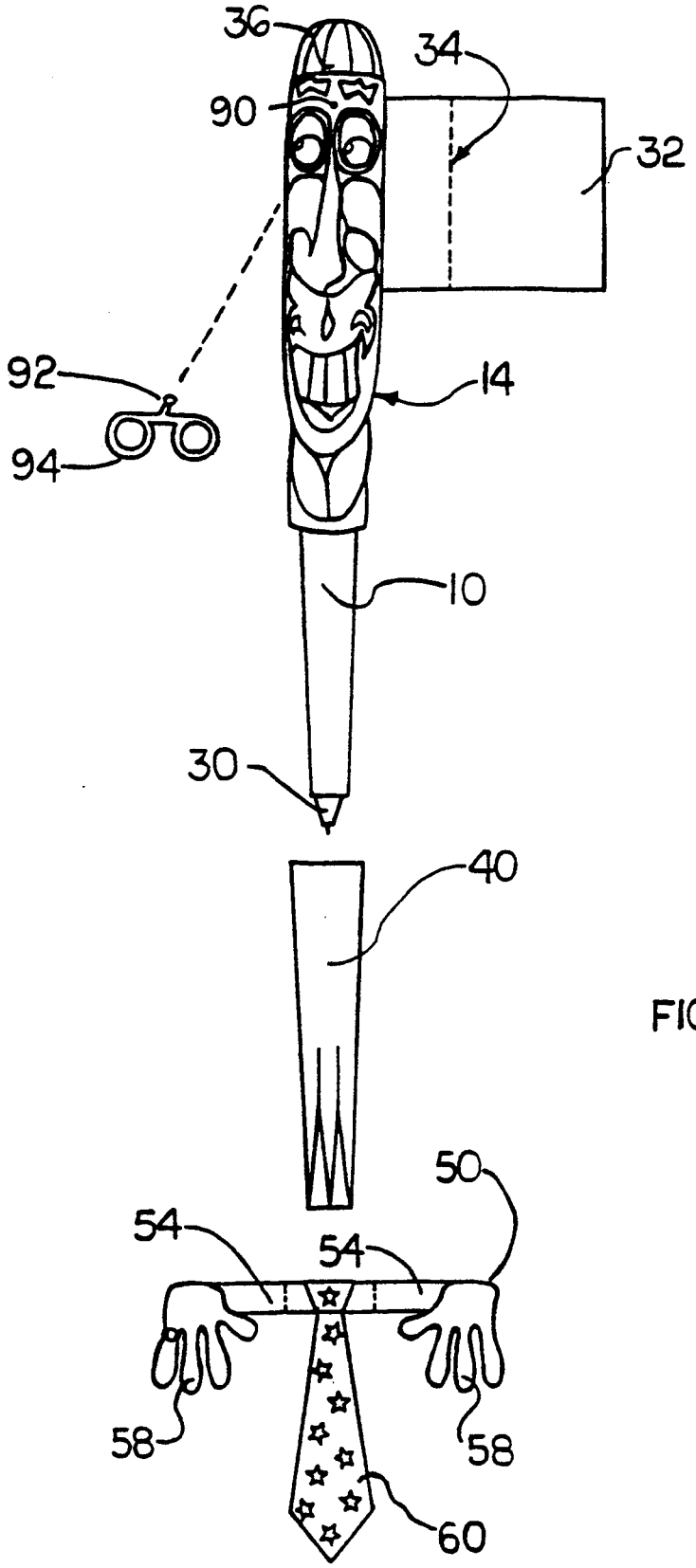
FIG. 1 is a front view of a writing instrument in accordance with the present invention.
Figure 2:
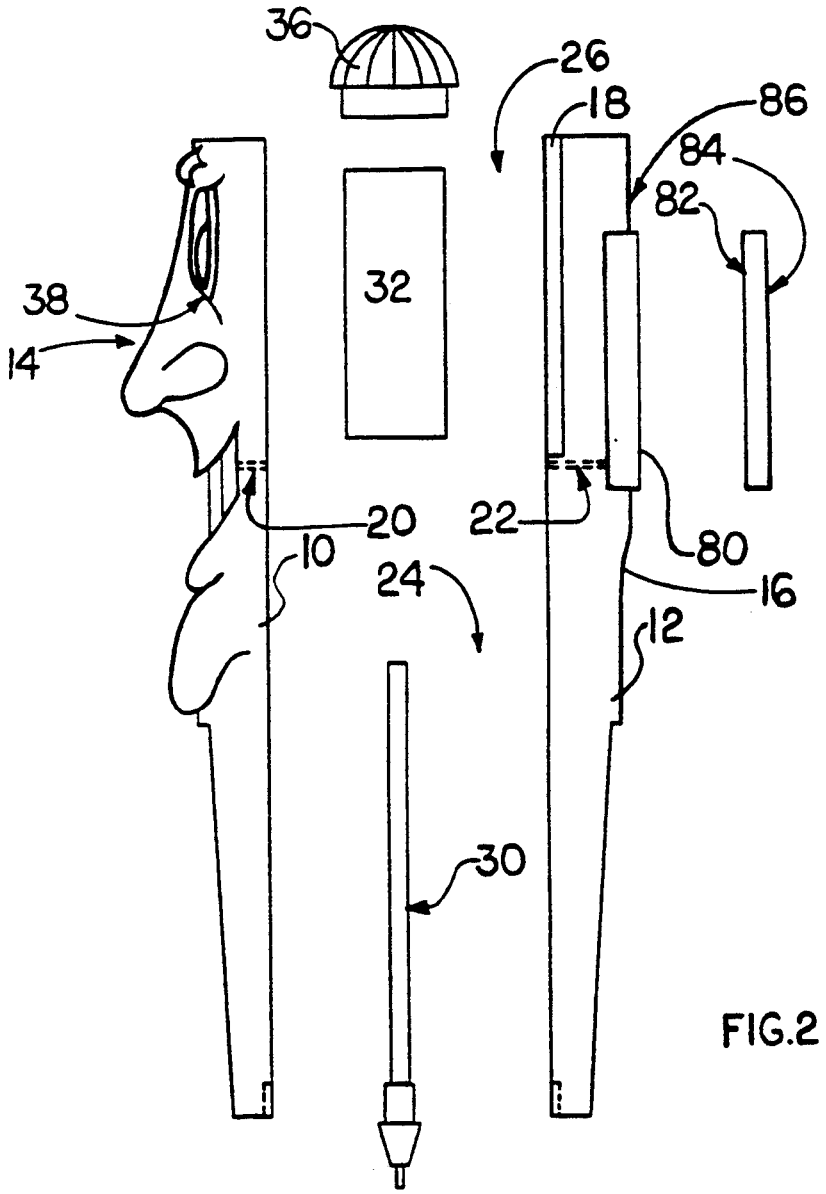
FIG. 2 is a side exploded view illustrating the parts of FIG. 1.

With reference to FIGS. 1 and 2, a pen body has a forward portion or half 10 and a rearward portion or half 12 which are fastened together. A caricature or face 14 is molded into the forward pen half. In the illustrated embodiment, the rear pen half includes no details of the caricature to facilitate its use with a plurality of different caricatures with the same rear half. The rear half 12 of the pen is specially contoured 16 to conform to the user's hand and facilitate holding of the pen. A plurality of alignment or "scrunch" pins are provided between the halves to assure accurate mating during assembly. The halves are preferably fastened together by ultrasonic welding, a non-contact, non-fusion welding technique in which plastics are joined by coalescence or atomic movement stimulated by high frequency vibrations. The rear half 12 defines a cut out region 18 which defines a paper exit slot.

The front pen half and the rear pen half define mating divider wall portions 20, 22 which divide the pen into a nib cavity 24 and a paper cavity 26. A small aperture 28 is defined in the divider walls 20, 22 such that the nib cavity is vented to the atmosphere. This aperture provides for pressure equalization which releases any vacuum which might be created and allows ink to flow from an ink reservoir to a writing ball of a pen nib 30. Alternately, when a felt tip marking pen or nib is utilized, the aperture is eliminated or sealed to insure that solvent based inks do not evaporate from the nib cavity. The nib 30 may be installed prior to the ultrasonic welding process. Alternately, the nib may be pressure fit after the ultrasonic welding process.

The paper cavity 26 extends above the divider wall portions 20, 22 at the lower edge of the slot 18. The paper cavity is generally cylindrical to accommodate a roll 32 of paper. Preferably, the paper is specially perforated 34 to facilitate the neat severance of a piece of note paper. A domed top 36 closes the upper end of the paper cavity. In the preferred embodiment, the top 36 has a tight interference fit with the interior of the front and rear pen halves at the top of the paper cavity. The cap includes grooves extending radially from a top center thereof to assist the user in rotating or manipulating the top to gain access to the paper cavity.

The caricature or face 14 includes integrally molded nose, eyebrows, lips, teeth, split chin, and comical smile. Recesses are defined for receiving eye assemblies 38 with moveable pupils. As the user writes with the pen, the face and particularly the eyes are jostled causing the pupils to move. The eye assemblies have an oval, white, opaque backing over which an oval, transparent eye lens is sealed. The eye lens is spaced from the opaque backing such that a smaller black colored pupil is movably received therebetween. The eyes are fixed with hot melt glue in the preferred embodiment. However, other adhesives or welding techniques may be utilized to permanently fasten the eyes securely into the eye sockets. Once the ink reservoir is depleted, the pen assembly can continue to be used as a novelty item.

A pen cap 40 is a tapered, removable cylinder with only the large end completely open. The small end of the cap is sealed except for a small diameter safety hole. That is, if the cap were inadvertently swallowed by a child and became lodged in the child's throat, the safety hole is of a sufficient diameter to allow the child to breathe until the cap can be safely dislodged. The cap is of sufficient dimension to conceal the pen nib to prevent accidental marking of shirts and protect the point from damage when the pen is dropped. The cap has a plurality of ridges that blend smoothly into the more rounded middle of the cap which aid the user in grasping and removing the cap. The cap fits onto a lower portion of the pen body with the open top fitting below the caricature's chin. Both the lower pen body and the pen cap are tapered to insure a tight, friction fit.

With continuing reference to FIG. 1 and further reference to FIG. 3, a shirt or pocket clip 50 retains the pen in a user's shirt pocket. The pen clip 50 includes a retaining ring 52 from which support bracket means 54 extend. The ring 52 is a plurality of tapered, vertical ribs 56 which engage a lower portion of the cap in tight frictional engagement when the clip is frictionally positioned on the cap. A pair of hands 58 extend downward from the support brackets 54 for engaging a forward surface of the user's shirt pocket. A tie 60 extends downward and forward for engaging the front surface of the user's pocket. The tie may be mounted to the ring 52 or a single support bracket may extend in front of the ring and mount the tie and both hands. The pocket clip with the hands, tie, and pen body utilizes multi-point attachments or contact surfaces. Optionally, as illustrated in FIGS. 4A and 4B, the pocket clip may be connected to the pen body with a C-shaped snap ring 62.

With reference to FIG. 5, a foam ball 70 is optionally inserted under the top 36 and pressed into frictional engagement with the paper roll 32 as the top is inserted. The foam ball provides a friction brake which limits free rotation of the paper roll.

When the optional foam brake 70 is provided, the foam acts as a friction brake to insure that the paper roll does not free wheel and unintentionally unravel paper from the pen. The foam, which is held by compression and friction within the cap, expands and contracts to accommodate rolls of paper of different widths.

Figure 6:
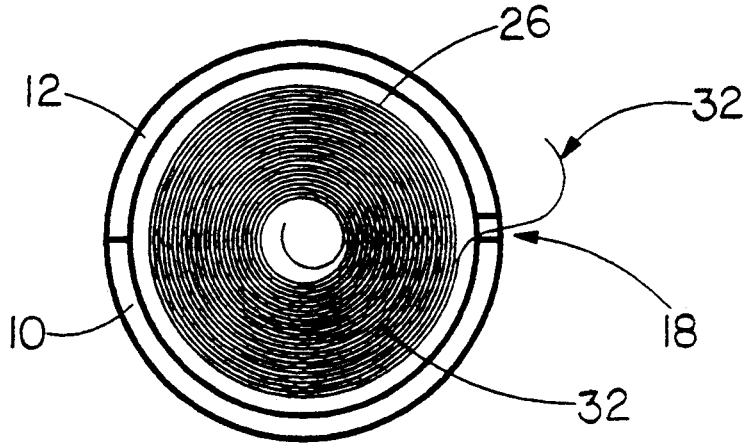
FIG. 6 is a top view with top removed and the face deleted for simplicity of illustration.

With reference to FIG. 6, a specially manufactured paper roll of perforated paper 32 is received in the paper cavity. The user simply withdraws one or more sections of paper, as may be desired, and detaches the paper sheets along the perforation 34. No additional components or cutters are required. When used up, the roll is easily replaced by removing the top 36 and inserting in a new roll of paper. Alternately, the cavity may be used to store small items such as paper clips, stamp roll, rubber bands, push pins, coins, and the like.

Figure 7:
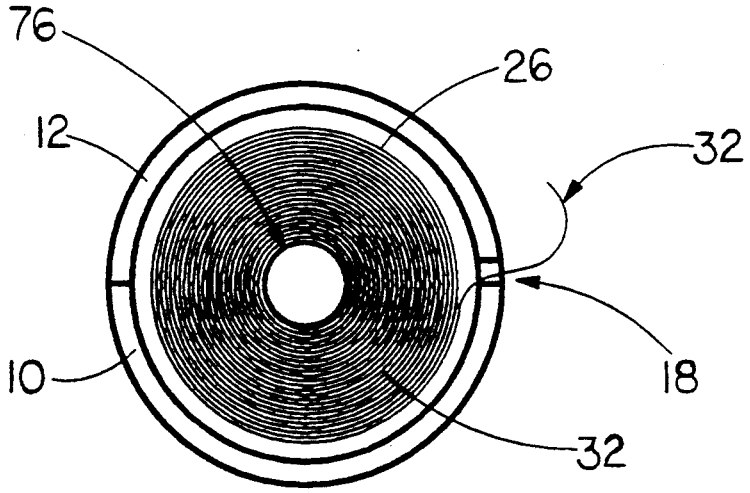
FIG. 7 is a top view with the top removed in which the paper is wound on a core.

As yet another alternative, the top has outward projections 72 which are engaged under an inward peripheral ring 74 at the top of the paper cavity such that the top is frictionally retained to the top of the pen, but free to rotate through a full 360°. Paper is dispensed or retracted by turning the top. The foam ball 70 transmits the rotational force to the paper roll 32. For a more reliable transfer of the rotational force, a paper core 76 may be affixed, such as with glue, in the center of the roll, as illustrated in FIG. 7.

In yet another alternate embodiment, one or both ends of the paper roll are coated with an adhesive material. The adhesive may be applied with a spray, brush, or dip operation. The hardened adhesive would secure the paper edges together preventing the paper from unintentionally unwinding. Yet, the width and the strength of the adhesive is sufficiently small that the paper can be unwound by the operator. Analogously, a permanently tacky adhesive could be applied adjacent to one edge of the paper roll such that as each sheet of paper is ripped off, it can be selectively adhered to a selected object.

Optionally, the paper may also be printed or watermarked with a background design or impression. The background design or impression can be utilized to customize the pen for group purchases, such as club insignia, advertising messages, or the like.

In operation, the replaceable roll of perforated paper is inserted in the paper cavity 26 with a small portion of the leading edge extending through the paper slot 18. The top 36 and, where used, the foam ball 70 are inserted. The operator grasps the exposed, leading edge and withdraws a sheet, thus unwinding the roll. When a perforation 34 and about a half inch of the next sheet are exposed, the user grasps the sheet between the thumb and index finger of one hand and holds the leading edge of the adjoining sheet and pen with the other. The sheet to be removed is then torn from the roll at the perforation. Once the paper sheet is removed, the user makes appropriate notes on the paper with the pen. The sheets can be utilized for writing addresses, telephone numbers, secret messages, notations, reminders, making calculations, drawings, scribblings, and the like. No sharp or jagged edges are required around the paper slot. The sheets are detached with clean borders without the safety hazard to small children.

The pen includes a number of other child or user safety features. Both the top 36 and the pen cap 40 have a small diameter safety hole, such as a 3/16 inch hole. If either the top or the cap becomes lodged in a child's throat, the safety hole serves as an air passage so that the child can continue breathing, albeit in a restricted manner, until the cap or top can be removed. Sharp or jagged edges have been minimized and eliminated. The perforated paper roll eliminates the need for sharp cutting edges. Molded plastic construction also provides for smoother surfaces to prevent cutting and abrasions. The pen is constructed of a non-toxic plastic material, preferably styrene. The eyes are set in eye socket recesses which are surrounded by a circumferential lip. The lip guards the edges of the eyes such that a child cannot pry the eyes from the pen. Optionally, the eyes may be integrally molded with a barbed stem which is ultrasonically welded into apertures in the front half. The tight interference fit between the nib and the pen body insures that the nib cannot be removed by small children. To tighten the fit, small vertical ribs are located on the inside portion of the nose cone aperture of the pen where the pen nib nose frictionally engages the pen body.

In the illustrated embodiment, the hands and necktie are spaced in appropriate distance to retain the clip on the user's shirt pocket. Preferably, the members are sufficiently flexible that at least the hands can be flexed further forward to accommodate clipping the pen to thicker objects, such as a soft cover of a notebook, a baseball cap, a car visor, a jacket lapel, or the like. Alternately, the hands and tie can be placed further forward to accommodate such thicker structures.

With reference again to FIG. 2, one portion of a hook and loop, self-gripping fastener so is connected to the rear pen portion. Another hook and loop self-gripping fastener portion 82 with an adhesive back is provided. A peel off surface 84 of the adhesive back is removed to expose the adhesive and the second portion attached to a wall or bulletin board, adjacent to a telephone, an automobile visor, or other location in which the pen will regularly be stored. The hook and loop self-gripping fastener portions are selectively mated to mount the pen and separated when the pen is to be used. The rear half 12 has a specially contoured surface portion 86 to facilitate attachment of the hook and loop material.

Various other caricatures may also be utilized. These caricatures may include famous people, cartoon characters, popular musicians, performing animals, holiday designs, and the like. Moreover, the caricatures may be of the products of corporations using the pen for advertising and promotional purposes, such as beverage bottles, food or tobacco boxes or containers, and the like.

With reference again to FIG. 1, optionally small holes or bores 90 are provided at selected locations on the caricature for receiving accessories. For example, one or more of the small bores 90 may be provided adjacent the eyes such that a projecting pin 92 from a pair of appropriately sized glasses 94 can be snap fit into an appropriate position on the caricature. Analogously, small bores can be provided for receiving snap pins attached to different sunglasses, ears, noses, lips, teeth, mustaches, wigs, beards, and the like. Bores can also be provided to receive other accessories which customize the caricature to the personality of the user, such as a guitar, football, golf club, cigar, sports equipment, tools, beverage bottle, beach equipment, computer, and the like.

As yet another alternative, the top 36 can have a shape of an accessory such as a cowboy hat, baseball hat, derby, hard hat, football helmet, and the like. Alternately, the cap top may be covered with a fuzzy or furry material to simulate hair.

Various themes can be used on the pocket clip 50, such as baseball glove, hand holding a baseball, and a baseball shirt; a hand holding a football, an empty hand, and a football jersey; a guitar, a microphone, and a pair of hands; an apron and hands; and the like.

The invention has been described with reference to the preferred embodiments. Obviously, modifications and alterations will occur to those of ordinary skill in the art upon reading and understanding the preceding detailed description. It is intended that the invention be construed as including all such alterations and modifications insofar as they come within the scope of the appended claims or the equivalents thereof.

Having thus described the preferred embodiment, the invention is now claimed to be:

1. A memorandum paper dispensing caricature pen comprising:

an elongated body portion which defines a nib receiving cavity in the lower portion, and defines a paper receiving cavity in an upper portion thereof, the elongated body including a rear body piece and a front body piece which are fastened together along longitudinal seams to define the elongated body;

a caricature face molded into the upper portion of the front body piece, the rear body piece being configured to fasten with the front body piece when any one of a plurality of face caricatures is molded into the front body piece, whereby a common rear body piece is usable with a plurality of face caricatures;

a notch defined extending longitudinally along an edge of the rear body piece along the paper receiving cavity, the hatch interacting with an adjoining edge of the front body piece to define a slot in communication with the paper receiving cavity;

a roll of paper received in the paper receiving cavity with a leading edge extending through the slot;

a top removably received in an upper end of the paper receiving cavity to facilitate inserting replacement rolls of paper;

a nib received in a lower end of the body and extending into the nib receiving cavity;

a plurality of accessories;

a connecting means for selectively interconnecting each of the accessories with the body front piece upper portion.

2. The pen as set forth in claim 1 further including a compressible foam member frictionally inserted between the top and the paper roll for braking rotation of the paper roll, the foam member permitting the paper to be pulled from the roll through the slot, the top being rotatably received in the top end of the paper cavity such that the foam member transfers rotational force between the top and the paper roll for selectively retracting the paper into the paper cavity.

3. The pen as set forth in claim 1 wherein the caricature includes recessed eye sockets in which moveable pupil eye structures are mounted, the moveable pupil eye structures including an opaque backing layer, a transparent lens structure spaced from and peripherally sealed to the backing layer, and a pupil member movably received therebetween.

4. The pen as set forth in claim 1 wherein the accessory connecting means includes small bores defined in the caricature and a mating pin which is selectively received in the bore attached to each accessory.

5. The pen as set forth in claim 1, wherein the accessories includes at least one of glasses, sunglasses, facial features, sports equipment, tools, beverages, food products.

6. The pen as set forth in claim 1 further including:

a means for at least partially encircling a nib end of the writing instrument;

a pair of downward projecting structures disposed to be received on an opposite surface of an object than the front and rear body portions;

a means for connecting the downward projecting structures with the partially encircling means and displaced from the body such that the object is not clamped between the downward projecting structures and the body.

7. The pen as set forth in claim 6 wherein the downward projecting structures are shaped like hands and further including a third downward projecting structure in the shape of a tie mounted between the hands.

8. The pen as set forth in claim 6 further including a cap which is frictionally received over the nib end.

9. The pen as set forth in claim 8 wherein the at least partially encircling means includes an annular ring which is dimensioned to be received over one end of the nib end and the cap, the annular ring defining at least three tapered ribs therein such that the ring moves into progressively greater frictional engagement to assure a secure frictional fit therebetween.

10. A memorandum paper dispensing caricature pen comprising:

an elongated body which defines a nib receiving cavity in a lower portion and defines a paper receiving cavity in an upper portion;

a nib received in a lower end of the body extending into the nib receiving cavity;

a caricature of a face molded into the body upper portion;

a slot defined extending longitudinally along the upper body portion displaced from the molded facial caricature along the paper receiving cavity;

a roll of paper received in the paper receiving cavity with leading edge extending through the slot;

a top closing an upper end of the paper receiving cavity;

a cap removably received on the body lower portion to protect the nib;

at least one longitudinally extending structure connected adjacent an upper end of the cap and having a free end extending downward away from the facial caricature, the longitudinally extending structure being adapted to receive a top edge of a pocket thereunder such that the cap is received in the pocket and the facial caricature extends out of the pocket.

11. The pen as set forth in claim 10 wherein the top is rotatably mounted in the paper receiving cavity and further including a sponge member compressively received between the top and paper roll for transmitting rotational force from the top to the roll.

12. The pen as set forth in claim 10 wherein the at least one longitudinally extending structure includes:

a pair of downward projecting structures disposed adjacent and physically displaced from the body lower portion;

a means extending transversely for connecting the downward projecting structures with one of the cap and the body, the downward projecting structures being sufficiently displaced from the cap and body that a received surface is not clamped therebetween.

13. The pen as set forth in claim 12 wherein the downward projecting structures are shaped like hands.

14. The pen as set forth in claim 10 wherein the cap and the top each have an aperture therethrough of a sufficient diameter to enable a child who has swallowed the cap or top to continue breathing until the cap or top is dislodged.

15. The pen as set forth in claim 12 wherein the means for connecting the downward projecting structures includes an annular ring which is dimensioned to be received over a generally cylindrical portion of the cap, the mounting ring defining three inward projecting, longitudinally disposed tapered ribs therein to insure a firm frictional interconnection to the cap.

16. The pen as set forth in claim 10 wherein the elongated pen body includes a front body piece and a back body piece which are seamed longitudinally, the caricature face being molded only into the front body piece such that the rear body piece is useful with other face caricatures.

17. The pen as set forth in claim 16 wherein a notch is defined along a side edge of the rear body piece such that the notch and an edge of the front body piece interact to define the slot.

18. A memorandum paper dispensing caricature pen comprising:

an elongated body portion which defines a nib receiving cavity in the lower portion, and defines a paper receiving cavity in an upper portion thereof, the elongated body including a rear body piece and a front body piece which are fastened together longitudinally to define the elongated body;

a caricature face molded into the upper portion of the front body piece, the rear body piece being configured to connect with the front body piece;

a notch defined extending longitudinally along one edge of the rear body piece along the paper receiving cavity, the notch interacting with an adjoining edge of the front body piece to define a slot in communication with the paper receiving cavity;

a roll of paper received in the paper receiving cavity with a leading edge extending through the slot;

a top removably received in an upper end of the paper receiving cavity to facilitate inserting replacement rolls of perforated paper;

a nib received in a lower end of the body extending into the nib receiving cavity;

a cap removably received on the body lower portion to protect the nib;

a ring means at least partially encircling one of the lower end of the body and the cap;

a pair of downward projecting structures disposed to be received on an opposite surface of an object than the front and rear body portions;

a resilient, transverse connecting means for resiliently connecting an upper end of the downward projecting structures with the partially encircling ring means, the downward projecting structures having free ends extending downward toward the nib and away from the caricature face, the downward projecting structures being displaced from the body such that the downward projecting structures resiliently engage the object without clamping the object between the downward projecting structures and the body.

* * * * *